United States Patent [19]

McCabe

[11] Patent Number: 4,905,344

[45] Date of Patent: Mar. 6, 1990

[54] HEAT ACTUATED LINK

[76] Inventor: Francis J. McCabe, 239 Hastings Ct., Doylestown, Pa. 18901

[21] Appl. No.: 342,411

[22] Filed: Apr. 24, 1989

[51] Int. Cl.[4] ..... E05F 15/20

[52] U.S. Cl. ..... 16/48.5; 49/2

[58] Field of Search ..... 16/48.5; 49/2; 160/6

[56] References Cited

U.S. PATENT DOCUMENTS 3,725,972 4/1973 McCabe ..... 16/48.5

3,889,314 6/1975 McCabe ..... 16/48.5

*Primary Examiner*—Nicholas P. Godici

*Assistant Examiner*—Carmine Cuda

*Attorney, Agent, or Firm*—P. C. Benasutti

[57] ABSTRACT

A resettable heat actuated link having an associated releasable member comprises first and second gripping portions for acting cooperatively to engage the releasable member in a normal position and to release the releasable member in an activated position. Along with the first and second gripping portions there is provided a heat responsive bimetallic element for causing the gripping portions to move to the normal position in response to ambient temperature and to cause the first and second gripping portions to move away from each other to an activated position in response to a preselected increase above the ambient temperature and to release the releasable member at the increased temperature. The first and second gripping portions, the heat responsive bimetallic element, and a base for mounting the link are integrally formed from a single bimetallic strip.

1 Claim, 1 Drawing Sheet

HEAT ACTUATED LINK

BACKGROUND OF THE INVENTION

1. Field of the Invention

This invention relates to heat activated links for use in automatically actuated equipment forming a part of fire fighting systems, and in particular to a resettable heat activated fire link for use with such systems.

2.Prior Art

The present invention generally relates to releasing devices, and more particularly, releasing devices employing bimetallic elements. These releasing devices are conventionally useful to actuate various fire protection equipment in response to increases in heat in the vicinity of the device.

Conventionally, fusible or meltable releasing devices have been used. These fusible or meltable releasing devices included such things as fusible links and cables which ar held under tension in normal conditions and which are actuated by the melting of the link and the resulting break in the cable. However once activated, these links could not be reset. Thus it was not convenient or economical to test systems using these links.

It is also known in the art to use bimetallic links such as those taught in U.S. Pat. No. 3,889,314 entitled "Heat Actuated Link" and U.S. Pat. No. 3,725,972 entitled "Fire Link and Method of Actuating Link". The bimetallic links taught in these patents included a releasing element having a bimetallic strip attached thereto. The bimetallic strip and the releasing element acted cooperatively to engage a pawl having an aperture. The aperture was engaged by a pin coupled to the bimetallic element in the normal unactuated position of the link and released as the tip of pin coupled to the bimetallic element separated from a mounting or a striker portion of the link to release the pawl. These bimetallic links have conventionally been installed by attaching a cable to either the pawl, a mounting element attached to the bimetallic element, or both in a manner similar to that used for the fusible or meltable links described above.

These bimetallic links have exhibited certain advantages compared with the prior art fusible links in that following a return to normal temperatures, the link may be reset simply by reinserting the pawl into the remaining link assembly by resiliently moving the pin portion of the link. However, these links were somewhat difficult and expensive to construct because they were formed of several parts requiring assembly and fastening as well as the inconvenience of maintaining an inventory of many small parts. In addition to being more expensive and more inconvenient, the number of parts increased the risk of failure of the links.

These parts which were assembled included at least a base portion, a pin and a washer associated with the pin. Additionally, these links included further parts such as the bimetallic element and an insulating material between the bimetallic material and the base portion. Rivets were often required to attach the bimetallic element to the base causing additional construction expense and additional opportunity for failure. Finally, a pawl was often required for releasable engagement with the link.

In addition to the number of parts, another problem with prior art heat actuated links wa their size. When trying to miniaturize heat actuated links a limiting factor is the length of the bimetallic element. The length of the element is a limiting factor because the temperature at which a link is activated depends upon the length of the bimetallic strip element. In order to provide a new link actuated at the same temperature as a prior art link, the new link was required to have substantially the same length bimetallic element in order to operate at the same temperature range. Therefore the size of the new link has approximately the same length bimetallic element.

Therefore it is an object of the present invention to provide a heat actuated link avoiding the need for many individual parts requiring assembly and fastening a in the prior art heat actuated links.

Additionally, it is an object of the present invention to provide a heat actuated link wherein a link may operate at the same temperature as a prior art link while having a more compact size than the size of a prior art link.

SUMMARY OF THE INVENTION

A resettable fire link having an associated releasable member comprises first and second gripping portions for acting cooperatively to engage the releasable member in a normal position and to release the releasable member in an activated position. Along with the first and second gripping portions there is provided a heat responsive bimetallic element for causing the gripping portions to move to the normal position in response to an ambient temperature and to cause the first and second gripping portions to move away from each other to an activated position in response to a preselected increase above the ambient temperature and to release the releasable member at the increased temperature. The first and second gripping portions, the heat responsive bimetallic element, and a base for mounting the link are integrally formed from a single bimetallic strip.

DETAILED DESCRIPTION OF THE INVENTION

Figure 1:
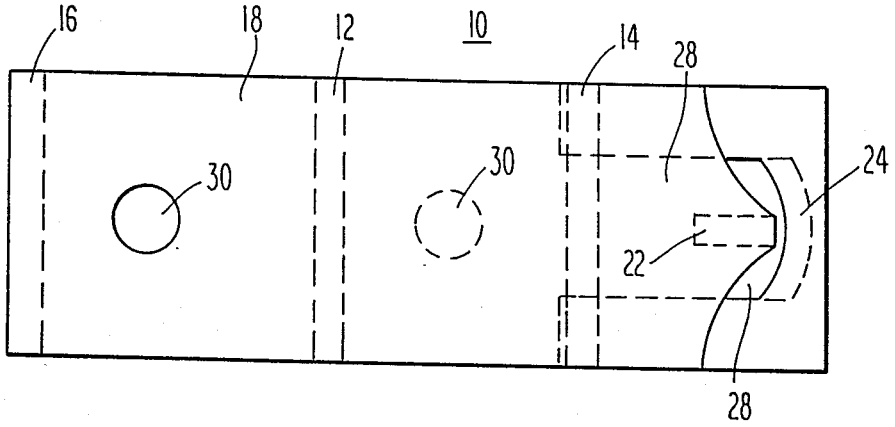
FIG. 1 is a top view of a resettable heat actuated link in accordance with the present invention.

Although the specific forms of the invention have been selected for illustration in the drawings and the following description is drawn in specific terms for the purpose of describing these forms of the invention, this description and these drawings are not intended to limit the scope of the invention which is defined in the appended claims.

Figure 2:
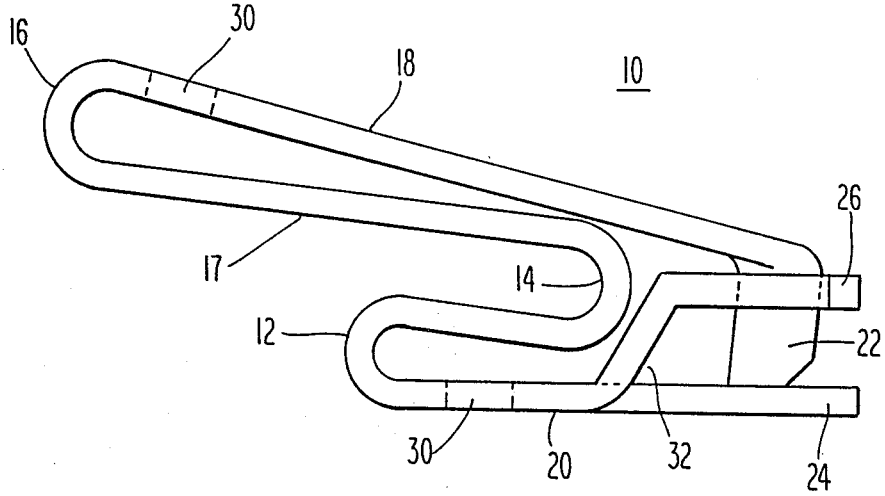
FIG. 2 is a side view of the resettable heat actuated link of FIG. 1.
Figure 3:
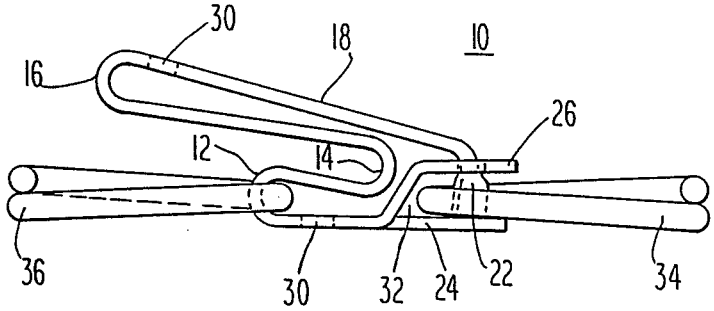
FIG. 3 is a side view of the resettable heat actuated link of FIG. 1 showing the retention of hooks by the link in an unactuated position.

FIGS. 1, 2 show, respectively, top and side views of resettable heat actuated link 10 of the present invention. FIG. 3 shows resettable heat actuated link 10 securing hooks 34,36 which may be coupled to a cable (not shown) or other device for use in fire fighting and other equipment. Resettable heat actuated link 10 is formed of a single integral serpentine bimetallic strip and is designed for use in automatically actuated equipment forming a part of fire fighting and other systems. In order to serve this purpose resettable heat activated link 10 is adapted to respond to an increase in ambient temperature by allowing the separation of hook 34 from resettable heat actuated link 10 at a predetermined temperature.

Heat actuated link 10 of the present invention may be used to actuate a wide variety of fire fighting systems. One method for utilizing link 10 of the present invention is to join a fire door, fire damper, air duct, fire curtain or similar fire fighting device to hook 34. Since long term tension is exerted on heat actuated link 10 by hook 34 coupled to such a fire fighting device, heat actuated link 10 is, in its normal unactuated position, adapted to withstand these tensions for an extended period of time. As the ambient temperature around heat actuated link 10 increases to a predetermine level, indicating that a fire is burning in the vicinity or that heat is rising in the vicinity, bimetallic heat actuated link 10 reacts to the increased temperature with a deformation in its configuration. This deformation results in a disengagement of hook 34 or other releasable member 34 from heat activated link 10, thereby activating the fire damper, fire door, or other responsive fire fighting device.

The entire structure of heat actuated link 10 is formed of one integral bimetallic strip. The single integral bimetallic strip is configured in a serpentine shape having a first bend 12, a second bend 14 and a third bend 16. First, second, and third bends 12, 14, 16 in the single integral bimetallic strip forming heat actuated link 10 divide the bimetallic strip into a bottom portion 20, a mid portion 17 and an top portion 18. The single integral length of bimetallic strip forming heat actuated link 10 forms all other elements required for proper functioning as a heat actuated link in addition to portions 17, 18, 20 and bends 12, 14, 16. These elements required for such functioning include a base, a pin and associated gripping parts, and means for responding to temperature. Additionally this integral construction eliminates the need for washers, insulating material and rivets which were required in prior art links formed of a plurality of parts.

Furthermore, the construction of heat actuated link 10 in which heat actuated link 10 is formed of a single integral bimetallic strip permits a heat actuated link 10 of a shorter length to operate at the same temperature as a prior art link having a less compact size The reason for this is that the link of the present invention uses a length of bimetallic strip to function as the base of the link. This length of the bimetallic strip which functions as the base is bottom portion 20. In order to have two different heat activated links function at approximately the same temperature range the individual bimetallic strips within the two links must be of approximately the same length. In prior art links the base was formed of an element other than a portion of the bimetallic link. By utilizing a portion of the bimetallic strip as a base in link 10 of the present invention, it is possible to more compactly fit a bimetallic strip required for a certain temperature response into a smaller space because part of the length of the bimetallic strip is used to form the base rather than a separate base material.

Tongue 24 of heat activated link 10 is cut or stamped from end section 26 of bottom portion 20 forming a slot 28 in section 26 of bottom portion 20. Section 26 of bottom portion 10 is bendably adapted to be elevated above the level of the remainder of bottom portion 20 and tongue 24 thereby creating space 32 between tongue 24 and elevated section 26.

At the opposite end of the bimetallic element forming heat actuated link 10 the free standing end of upper portion 18 is formed into pin 22. Pin 22 is thus formed of the same unitary bimetallic strip as tongue 24 at the opposite end of strip 24. Pin 22 is resiliently urged through slit 28 by the pretension in the serpentine configuration of the bimetallic strip and in a normal unactivated pin 22 state extends through slot 28 of elevated portion 26. The tip of pin 22 rests against tongue 24 of bottom portion 20 in this normal unactivated state. Pin 22, acting cooperatively with tongue 24 and elevated portion 26, closes off and encircles a portion of open space 32 between tongue 24 and elevated end section 26. Heat activated link 10 releasably secures ring 34 within this encircled space permitting outward force to be applied to pin 22 by hook 34 within space 32.

As the ambient temperature of the air around heat actuated link 10 increases to a predetermined level, indicating that a fire is burning or that heat is rising in the vicinity of heat activated link 10, the bimetallic strip forming heat actuated link 10 reacts to the increase in temperature with a deformation in its serpentine configuration as previously described. This deformation results in top portion 18 of link 10 being both raised relative to bottom portion 20 as well as rotated counterclockwise with respect to the side views of FIGS. 2 and 3. This motion of top portion 18 removes pin 22 from the vicinity of space 32 by way of movement through slot 28. As pin 22 is moved upward through slot 28 hook 34 is no longer restrained within space 32 and hook 34 is disengaged from heat actuated link 10 thereby activating the fire damper, fire door or other responsive device coupled to hook 34.

Hook 34 can pull against hook 36 within bend 12 of heat activated link 10 or against link 10 which may be mounted using mounting holes 30. If bottom hole 30 is used to mount heat activated link 10 then pin 22 moves away from tongue 24 during activation. If top hole 30 is used, tongue 24 moves away from pin 22 during activation. Similarly, if heat activated link 10 is not mounted by holes 30, for example if link 10 is suspended under tension between hooks 34, 36, then pin 22 and tongue 24 both move away from each other. Because both ends of link 10 are moving away from each other, as opposed to the prior art wherein only one end moved, link 10 can provide the same distance of travel of the gripping elements in a shorter overall length of link 10.

Heat actuated link 10, due to the serpentine configuration described herein above, has a movement response at a predetermined temperature. Thus heat actuated links 10 may be provided for response at differing temperatures by forming them of differing lengths of integral bimetallic strips or by adjusting pretension. Furthermore, heat actuated links 10 may be rated at differing weights against pin 22, for example eight pounds, ten pounds etc. in a conventional manner. Heat actuated link 10 may be adapted to hold hook 34 securely against a specified tension up to, for example, 185° F. and suddenly release hook 34 when the temperature of heat actuated link reaches 185° F. Similarly, heat actuated link 10 can be designed to have a releasing temperature response at 212° F. In such an embodiment heat actuated link 10 is tripped and releases hook 34 at 212° F. Links 10 can also be adapted to respond at temperatures below 185° F. and above 210° F. depending on the application.

Heat actuated link 10 is resettable after being activated. When heat activated link 10 returns to normal ambient temperature the shape of link 10 returns to that shown in FIGS. 2, 3 wherein pin 22 extends through slot 28 and the tip of pin 22 rests against tongue 24 of bottom portion 20. In this normal unactuated state, top portion 18 of link 10 may be resiliently forced upwards thereby withdrawing pin 22 through slot 24 to permit hook 34 to be reinserted all the way into space 32. When top portion 18 is released after reinserting hook 34 into space 32, pin 22 resiliently returns to its rest position against tongue 24. The amount of heat required to move pin 22 upwards through slot 22 depends on the pretension of the bimetallic strip forming link 10. If bends 12, 14, 16 are pressed tighter the pretension is increased and a higher temperature is required to activate link 10.

What is claimed is:

1. A resettable heat actuated link having a releasable member, comprising:

first gripping means associated with the releasable member;

second gripping means for acting cooperatively with the first gripping means to releasably engage the releasable member in a normal position and for releasing the releasable member in an actuated position;

base means coupled to the gripping means;

the first and second gripping means and the base means all being formed of single bimetallic strip of heat responsive means for causing the first and second gripping means to move to the normal position in response to a preselected ambient temperature and for causing the first and second gripping means to move to the actuated position in response to a preselected increase in the ambient temperature said second gripping means comprises a portion of the bimetallic strip having a tongue portion cut therefrom to form a tongue and a slot wherein the tongue and the slot are separated to permit the releasable member to be disposed therebetween.

* * * * *

UNITED STATES PATENT AND TRADEMARK OFFICE

CERTIFICATE OF CORRECTION

PATENT NO. : 4,905,344

DATED : March 6, 1990

INVENTOR(S) : Francis J. McCabe

It is certified that error appears in the above-identified patent and that said Letters Patent is hereby corrected as shown below:

In Column 1, line 20, after the word "which", delete the word [ar].

In Column 1, line 20, after the word "which", insert the word --are--.

In Column 1, line 64, after the word "links", delete the word [wa].

In Column 1, line 64, after the word "links", insert the word --was--.

In the Claims:

In Column 6, lines 11-12, after the word "temperature", insert --,--.

Signed and Sealed this

Twenty-third Day of April, 1991

*Attest:*

*Attesting Officer*

HARRY F. MANBECK, JR.

*Commissioner of Patents and Trademarks*